US006050388A

United States Patent [19]

Gautherot

[11] Patent Number: 6,050,388

[45] Date of Patent: Apr. 18, 2000

[54] DEVICE FOR SELECTING OBJECTS, PARTICULARLY COINS

[75] Inventor: Daniel Gautherot, Besançon, France

[73] Assignee: Schlumberger Systemes, Montrouge, France

[21] Appl. No.: 09/101,659

[22] PCT Filed: Jan. 9, 1997

[86] PCT No.: PCT/FR97/00036

§ 371 Date: Jul. 14, 1998

§ 102(e) Date: Jul. 14, 1998

[87] PCT Pub. No.: WO97/26627

PCT Pub. Date: Jul. 24, 1997

[30] Foreign Application Priority Data

Jan. 19, 1996 [FR] France ..... 96 00704

[51] Int. Cl.[7] ..... G07D 5/08

[52] U.S. Cl. ..... 194/317; 194/343; 194/346; 194/351

[58] Field of Search ..... 194/203, 317, 194/318, 334, 335, 338, 342, 343, 346, 351; 453/57

[56] References Cited

U.S. PATENT DOCUMENTS

| | | | |
|---|---|---|---|
| 4,407,312 | 10/1983 | Davila et al. | 453/32 |
| 4,625,851 | 12/1986 | Johnson et al. | 194/317 X |
| 5,050,719 | 9/1991 | Shimizu | 194/318 X |
| 5,404,986 | 4/1995 | Hossfield et al. | 194/343 X |
| 5,429,222 | 7/1995 | Delay | 194/343 |

FOREIGN PATENT DOCUMENTS

| | | | |
|---|---|---|---|
| 3541869 | 6/1987 | Germany | 453/57 |
| 566615 | 9/1957 | Italy | 453/57 |
| 2276483 | 9/1994 | United Kingdom | 194/317 |

*Primary Examiner*—F. J. Bartuska
*Attorney, Agent, or Firm*—Frishauf, Holtz, Goodman, Langer & Chick, P.C.

[57] ABSTRACT

A selector device for selecting objects (1) inserted by way of payment into a dispenser of goods or services via an insertion orifice (10), the device comprising a transport member (100) provided with a housing (110) designed to receive the objects singly and suitable for bringing an object (1) placed in said housing (110) into a measurement zone (ZM) where sensors (301, 302, 303) are disposed for verifying conformity of the object (1). According to the invention, the selector device also comprises drive mechanisms (200, 210) suitable for imparting a non-reversible continuous movement to said transport member (100) along a path during which the housing (110) passes from an initial position (P1) of communication with the insertion orifice (10) to a final or waiting position (P2), while passing through the measurement zone (ZM) in continuous manner, the sensors (301, 302, 303) for verifying conformity receiving sampling signals sampling the movement of the transport member (100). Applicable to dispensing services such as tickets for travel or parking purposes.

27 Claims, 7 Drawing Sheets

DEVICE FOR SELECTING OBJECTS, PARTICULARLY COINS

FIELD OF THE INVENTION

The present invention relates to a device for selecting objects inserted for payment purposes into a dispenser of goods or services.

A particularly advantageous application of the invention lies in the field of dispensing services, such as tickets for travel or for vehicle parking.

A dispenser of goods or services in exchange for payment in coin is known, e.g. from American U.S. Pat. Nos. 5,393,891 and 5,404,986, in which coins are inserted one by one through an insertion orifice, generally in the form of a slot. The coins inserted into the dispenser in this way are received by a selector device mainly constituted by a circularly shaped transport member suitable for being rotated about its axis which extends horizontally. In said transport member, there is provided a housing corresponding substantially to a sector of a circle, in which the coins are received one by one after being inserted into the dispenser, said housing having previously been put into communication with the insertion orifice.

By rotating about its axis, the transport member brings the coin that is to be found in the housing to a measurement zone where various operations are performed to verify conformity, in particular the diameter of the coin is determined by measuring the time it takes to move past an optical sensor, and the metal from which the coin is made is analyzed by a magnetic measurement performed statically, with the transport member being stopped in the field of an electromagnetic detector.

Then, from said stop position, the transport member can turn either in a first direction of rotation to direct the coin to a pre-encashment block if the coin is recognized as being in conformity, or else, otherwise, in a second direction of rotation, opposite to the first, towards an outlet for returning the coin.

That selector device known in the state of the art nevertheless suffers from the drawback of requiring the movement of the transport member to be stopped in order to analyze the metal of the coin present in the housing, and that slows down the coin processing system.

OBJECTS AND SUMMARY OF THE INVENTION

Thus, the technical problem to be solved by the present invention is to propose a selector device for selecting objects inserted by way of payment into a dispenser of goods via an insertion orifice, said device comprising a transport member provided with a housing designed to receive said objects singly and suitable for bringing an object placed in said housing into a measurement zone where means are disposed for verifying conformity of said object, which selector device makes it possible to accelerate the operations of verifying conformity so as to reduce the length of time objects are present in the measurement zone and thus reduce the time interval between two successive objects being inserted by the user into the dispenser.

According to the present invention, the solution to the technical problem consists in that said selector device also comprises drive means suitable for imparting a non-reversible continuous movement to said transport member along a path during which said housing passes from an initial position of communication with said insertion orifice to a final or waiting position, passing through said measurement zone in continuous manner, said means for verifying conformity receiving sampling signals sampling the movement of the transport member.

Thus, as explained in detail below, it is possible for the metal constituting the coin to be analyzed, for example, without requiring a pause in the measurement zone, with this being a consequence of the fact that it is possible to establish indicative parameters specific to the metal used from measurements taken at accurately reproducible positions of the coin in the measurement zone, which positions are provided by the sampling signals.

It is in this sense that the invention provides for said means for verifying conformity to comprise means for magnetically analyzing the material of said objects, suitable for expressing said analysis in terms of characteristic values of a curve representative of the magnetic signature of said objects, said characteristic values being sampled by means of said sampling signals.

According to an advantageous disposition of the invention, said means for verifying conformity comprise means for geometrically measuring said objects, suitable for expressing said measurements in terms of numbers of steps in the sampling signals, independently of the speed of the transport member. The term "geometrical measurements" covers, for example, measurements of diameter and of thickness which are two parameters enabling conformity of coins to be verified.

The geometrical measurements performed by the selector device of the invention are thus performed dynamically, as is the diameter measurement described in the above-mentioned American patents. Nevertheless, it should be observed that in the prior art selector device, diameter is determined by measuring the time taken for the object to go past and optical sensor, with the result depending on the speed of rotation of the transport member. In contrast, in the present invention, the measurement is performed as a function of the position of the object to be recognized, which position is known very accurately because the drive means samples the movement of the transport member. The measurement is thus independent of the speed of said transport member, thus avoiding any need to control said speed very accurately, and making it possible for measurement to be unaffected by external disturbances that may be applied to the transport member, such as:

- an attempt by the user to insert a second object while measurements are being performed on the previously inserted object; and
- a deliberate attempt at fraud by braking the transport member while measurements are being taken for the purpose of disturbing them.

According to another characteristic of the invention that is particularly advantageous, provision is made for the path of the housing between the initial and final positions also to pass continuously through a zone for accepting or rejecting objects, directing them either to an encashment outlet or to a return outlet following after the measurement zone. This constitutes a same-direction extension of the continuous movement of the transport member until the objects are accepted or rejected following the operations of verifying conformity as previously performed in the measurement zone, whereas the above-mentioned American patents require firstly a stop and secondly switching between two possible directions of rotation depending on the result of the verification. It will thus be understood that since the invention requires neither a stop nor a reversal of direction, this makes it possible to further reduce the time between two successive objects being inserted into the dispenser.

In the specification below, the term "encashment" is used both for direct encashment of objects in the money box of the dispenser, and for pre-encashment including intermediate storage of objects so that it is possible for them to be returned in the event of the transaction being cancelled by the user.

More particularly, said encashment and return outlets are disposed in series facing the continuous movement of the transport member, an object placed in the housing being suitable, under the action of gravity, for passing through the encashment outlet if the object has been recognized as being in conformity on leaving the measurement zone, or for passing through the return outlet if the object is recognized as not being in conformity on leaving the measurement zone, a normally-open moving flap for shutting the encashment outlet being brought into a closed position.

Finally, in a preferred embodiment of the invention, the measurement zone is disposed on the path of the housing in such a manner that said means for verifying conformity are implemented during the continuous movement of the transport member starting from the housing's initial, communication position, and after said housing has ceased to be in communication with the insertion orifice. This disposition makes it possible to recognize objects inserted in the selector device of the invention without the measurements as performed by the means for verifying conformity being affected by the external environment, which is particularly important when using optical means that are sensitive to interfering light which could pass through the insertion orifice.

BRIEF DESCRIPTION OF THE DRAWINGS

The following description given with reference to the accompanying drawings given as non-limiting examples, will make it well understood what the invention consists in and how it can be implemented.

DESCRIPTION OF THE PREFERRED EMBODIMENTS

Figure 1:
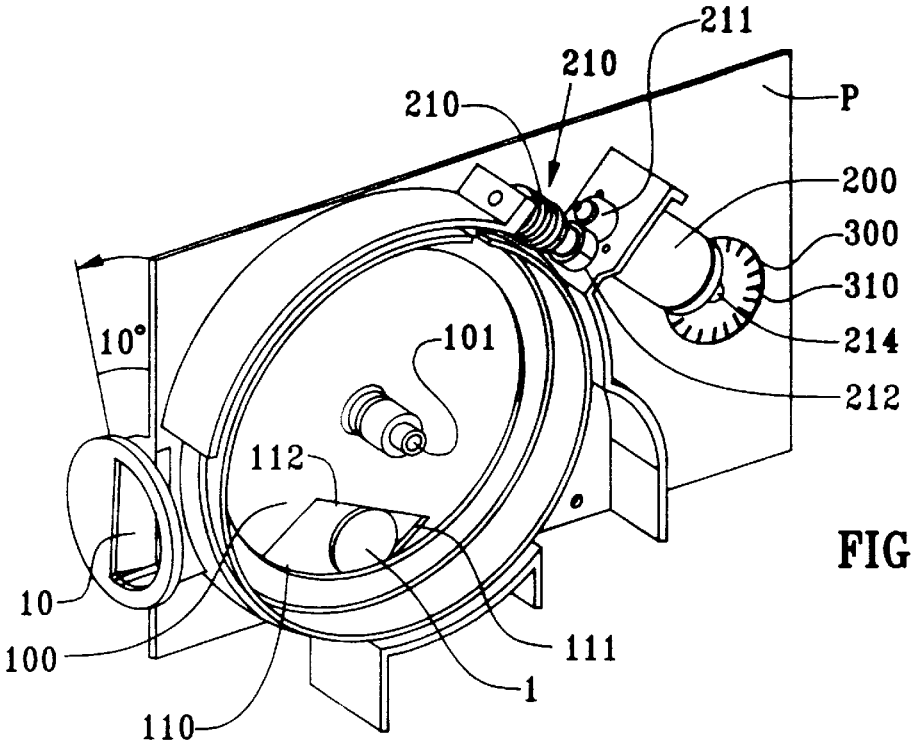
FIG. 1 is a perspective view of a selector device of the invention.

The selector device shown in perspective in FIG. 1 is designed to be fitted to a dispenser of goods or services in which objects, such as coins 1, are inserted by way of payment via an insertion orifice 10.

As shown in FIG. 1, said dispenser device comprises a transport member 100 having the general shape of a wheel in which a housing 110 is formed to receive the coins 1 singly.

The transport wheel 100 is suitable for being rotated about its axis 101 by drive means which, in the example of FIG. 1, are constituted by a DC motor 200 and a transmission mechanism 210 including stepdown gearing comprising two spur wheels 211, 212 coupled to a wormscrew co-operating with teeth (not shown) disposed on the periphery of the wheel 100. The helix of the wormscrew 213 is left-handed so as to urge the transport wheel 100 against the reference plane P during normal, clockwise rotation, thereby improving the measurement of the thickness of the coins 1 which, as explained below, constitutes one of the operations for verifying conformity applied to objects inserted into the selector device.

The motor 200 used is a high efficiency motor to keep down electricity consumption and a low-inertia motor to facilitate stopping the transport wheel 100 with good angular accuracy.

Figure 2A:
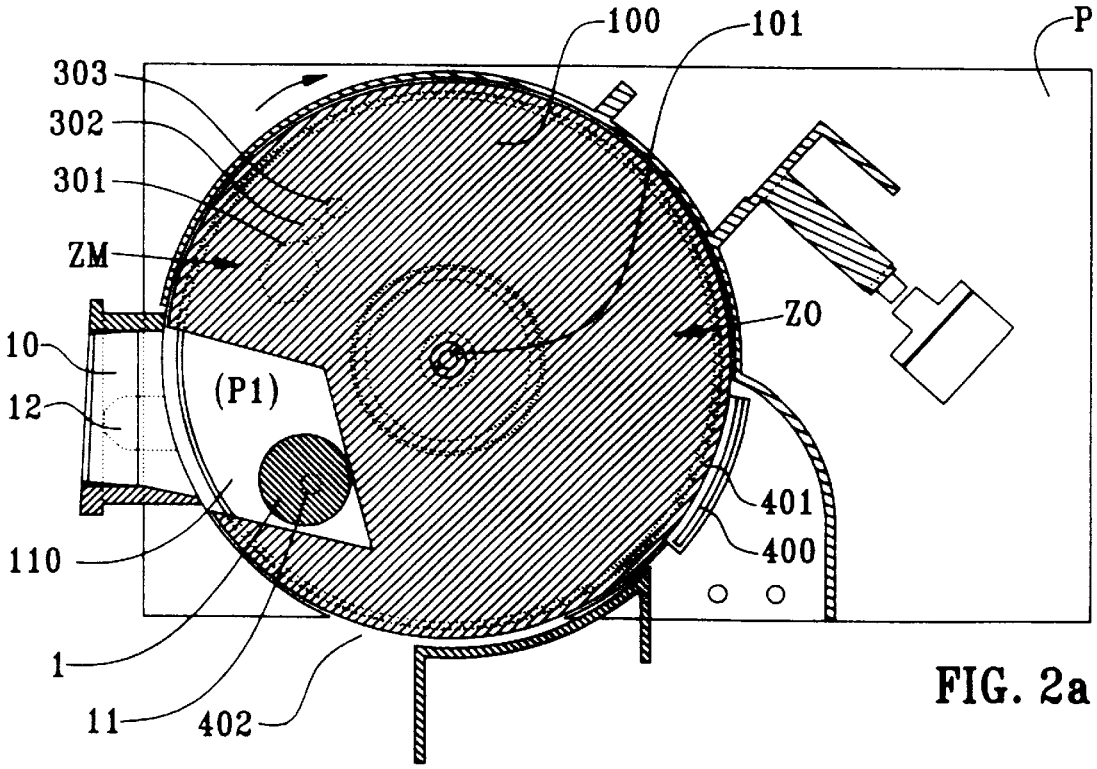
FIGS. 2*a* to 2*e* are side views of the FIG. 1 selector device for various positions of the housing in the transport member.

Under drive from the above-mentioned drive means, the transport wheel 100 is caused to rotate continuously and non-reversibly in the clockwise direction along a path during which the housing 110, starting from an initial position P1 shown in FIG. 2*a*, is brought to a measurement zone ZM in which means 301, 302, 303 are disposed for verifying conformity of the coin 1. Then, after passing continuously through said measurement zone ZM, the housing 110 arrives, still in the same movement, at a final position P2 shown in FIG. 2*e* and explained below.

As can be seen in FIG. 2*a*, when the housing 110 is in its initial position P1 it is in communication with the insertion orifice 10 so as to be able to receive a single inserted object 1.

Once an optical type detector 11 has recognized the object 1 as being opaque, and thus capable of being a coin, the motor 200 is put into operation so that the transport wheel 100 brings the coin 1 into the measurement zone where the operations of verifying conformity, as described below in detail with reference to FIGS. 3*a* to 5*b*, are performed continuously.

Figure 3A:
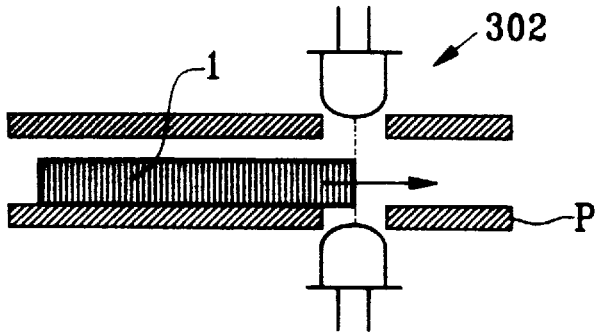
FIG. 3*a* is an end view of means for measuring the diameter of an object inserted in the selector device of the invention.

The means used for establishing conformity of inserted coins 1, include a diameter-measuring device shown in FIG. 3*a*, which device is essentially formed by an infrared emitter/receiver pair 302, for example. The measurement consists in recording the flux transmitted from the emitter to the receiver when the coin 1 goes past. As shown at (a) in FIG. 3*b*, the signal delivered by the receiver has a blanked-out time that is directly proportional to the diameter of the coin 1, but that also depends on the speed of rotation of the transport wheel 100. In order to obtain a result that is independent of the speed of rotation, the signal (a) coming from the emitter/detector couple 302 is compared with a sampling signal (b) relating to the movement of the transport wheel 100. Said sampling signal preferably comes from the drive means and not from the wheel itself, since given the stepdown ratio introduced by the transmission mechanism 210, it would be almost impossible in practice to achieve an equivalent sampling frequency from the wheel that is as high as that which can be obtained from the motor 200.

For this purpose, FIG. 1 shows a coder such as a coding wheel 300 having slots 310 and an optical fork (not shown) is mounted on the shaft 214 of the motor 200. The wheel 300 is constrained to rotate with the motor 200 and thus also with the rotation of the coding wheel 100. The sampling signal (b)

from the motor is constituted by a series of pulses, each pulse corresponding to a slot in the code wheel passing through the optical fork. Two consecutive pulses are spaced apart by a constant angular distance which corresponds, via the transmission mechanism 210, to a known angular pitch for rotation of the transport wheel 100. To convert to the linear pitch of advance of the coin 1, said angular pitch is multiplied by the distance of the detector couple 302 from the axis 101 of the wheel 100. It then suffices to count the number n2 of steps in the sampling signal (b) observed during the blanked-out time t2 to obtain an expression for the diameter as a number of steps, independently of the speed of rotation of the transport wheel 100.

Figure 4A:
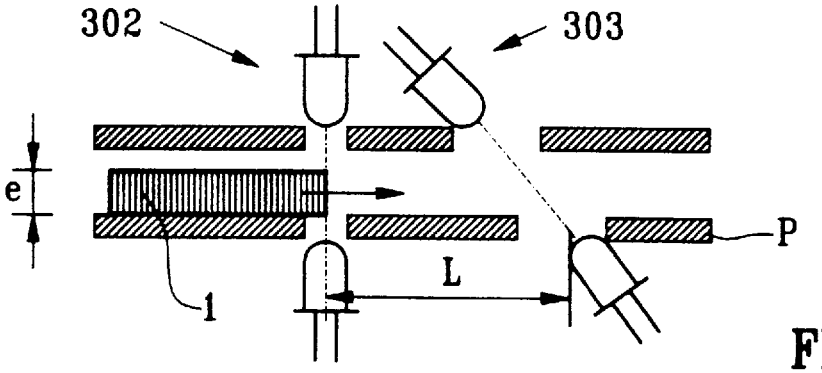
FIG. 4*a* is an end view of means for measuring the thickness of an object inserted in the selector device of the invention.
Figure 4B:
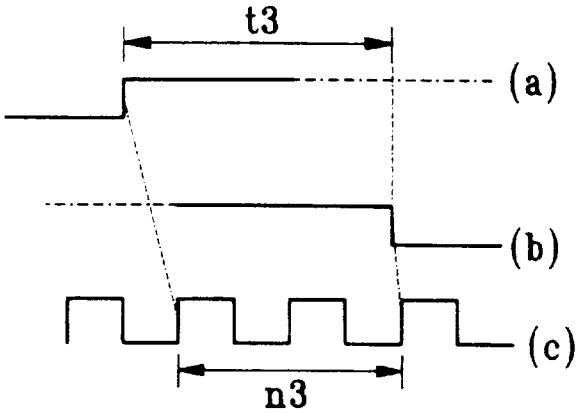
FIG. 4*b* is a timing chart of the thickness measurement provided by the means of FIG. 4*a*.

The thickness e of the coin 1 is measured in analogous manner, as shown in FIGS. 4*a* and 4*b*. The coin 1 passes initially through the emitter/receiver couple 302 used for measuring its diameter, and then through an identical second couple 303 placed on a slant, e.g. at an angle of 45°. The measured time t3 is the time between passing through the first couple 302 and passing through the second couple 303. It will be observed that the thicker the coin 1, the shorter this time. The time t3 is then expressed in terms of the number n3 of linear sampling steps, giving L-e and thus e, L being known by construction.

Figure 3B:
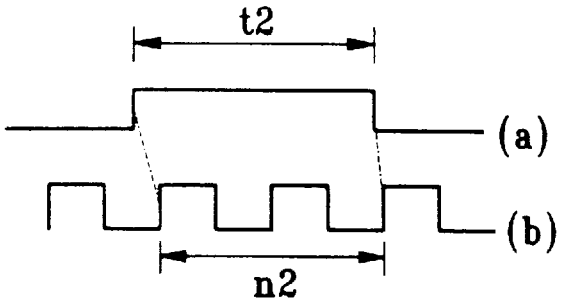
FIG. 3*b* is a timing chart of the diameter measurement supplied by the means of FIG. 3*a*.

Naturally, the sampling signals shown at (b) in FIG. 3*b* and at (c) in FIG. 4*b* could also be obtained by an encoder constrained to move with the transport wheel 100 itself. Such a device shall make it possible to use the measured movement of the wheel 100 directly as a reference. In this way, the diameter and thickness measurements are made independent of any possible variations in the speed of rotation of the wheel, whether arising from the drive system or from external disturbances, for example faulty gearing, inexact spacing, motor quality, or braking of the transport wheel 100. By way of example, said encoder is implemented by associating slots (not shown) formed at the circumference of the wheel with an optical sensor fork (not shown), in the same manner as the code wheel 300 having slots 310 in FIG. 1.

Figure 5A:
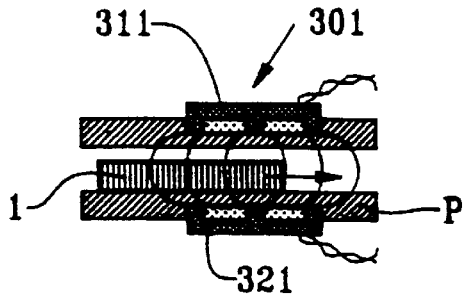
FIG. 5*a* is an end view of means for analyzing the metal of an object inserted in the selector device of the invention.
Figure 5B:
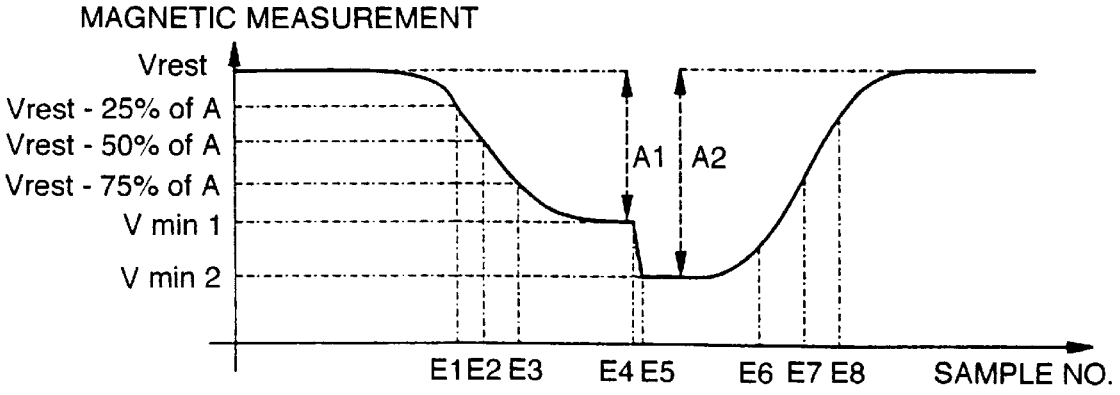
FIG. 5*b* is a timing chart of the metal analysis provided by the means of FIG. 5*a*.

The metal constituting the coin 1 is analyzed as follows. As shown in FIGS. 5*a* and 5*b*, the coin 1 driven in the housing passes through a magnetic field induced by a first coil 311 of a magnetic cell 301, and fed with an AC signal of fixed level and frequency. A measurement is performed on a second or receiver coil 321 placed facing the first or transmitter coil 311. It is thus possible to assess at the receiver coil 321 the disturbance to the magnetic field caused by the coin 1 passing through, said disturbance being characteristic of the metal of the coil. A sampled curve is thus obtained over time by means of the code wheel 300, each sample E1, . . . , E8 corresponding, for example, to a precise position of the coin 1 in the magnetic cell 301.

In order to characterize coins better, and as can be seen in FIG. 5*b*, the transmission frequency F can be changed at the instant when the coin 1 has passed halfway through the cell 301, e.g. by switching from F to 4F. This transition appears in FIG. 5*b* between sample E4 and E5.

From the response curve of FIG. 5*b*, which constitutes a kind of curve representative of the magnetic signature of coins, it is possible to express the analysis of the metal in terms of characteristic values taken from the curve.

These characteristic values can be of several types:

Attenuation type: this consists in identifying the sample at which the magnetic signal has been subjected to a drop of x%. In FIG. 5*b*, points E1, E2, E3 on one side and E8, E7, E6 on the other side are samples at which the signal is attenuated by 25%, 50%, and 75% respectively on the falling flank and on the rising flank of the signal.

Ratio type: this consists in taking the ratio of pairs of typical values for the magnetic signal. By way of example, in FIG. 5, the following ratios can be used:
ratio 1=Vmin1/Vrest
ratio 2=Vmin2/Vrest
ratio 3=Vmin1/Vmin2.

Overall signature type: this consists in characterizing the curve as a whole by means of a single value, e.g. the integral of the entire curve (area beneath the curve).

The accuracy, and above all the reproducibility of these measurements, and in particular the thickness measurement, require the object whose conformity is being verified always to be presented in the same position relative to the pairs of optical sensors and to the magnetic cell. For this purpose, various dispositions can be taken.

Figure 6:
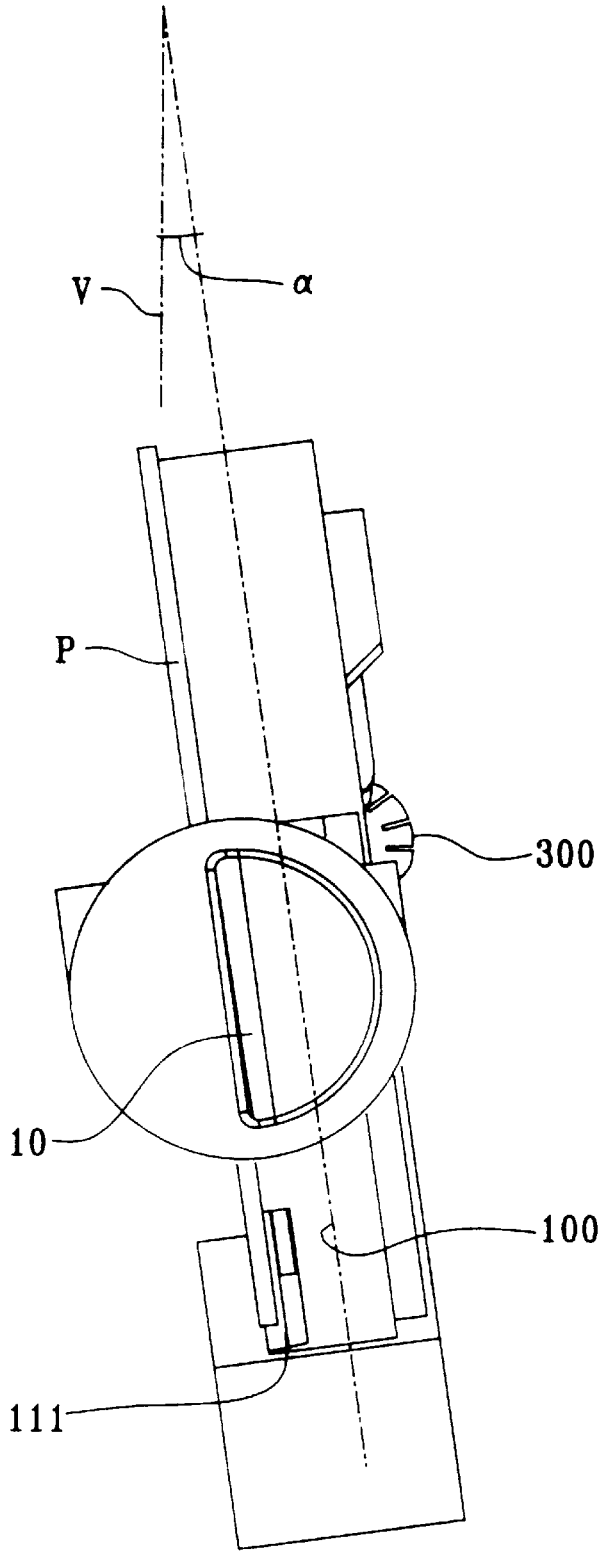
FIG. 6 is a front view of the FIG. 1 selector device.

As shown in FIG. 6, provision can be made for the transport wheel 100 to press against the reference plane P, which plane is inclined at an angle $\alpha$ of 10°, for example, relative to the vertical V. The object placed in the housing is thus held by its own weight against said reference plane at least while passing through the measurement zone ZM.

Also, as mentioned above, the pitch of the wormscrew 213 is handed so that friction against the teeth of the wheel 100 causes the wheel to be pressed against the reference plane P.

Finally, it is advantageous for the housing 110 to have edges 111 and 112 that come into contact with the object 1 (as shown in FIG. 1) that are of an inclined profile suitable for encouraging the holding of said object against the reference plane P, as can be seen in FIG. 6 for the edge 111.

Figure 2B:
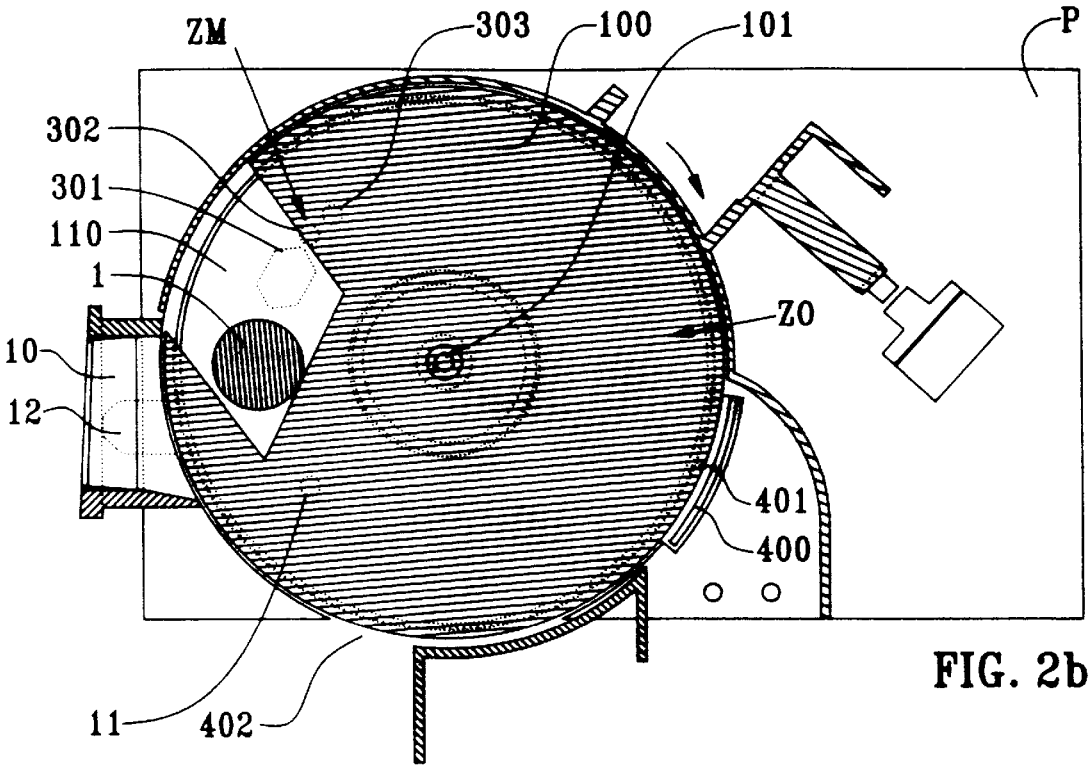
Figure 2C:
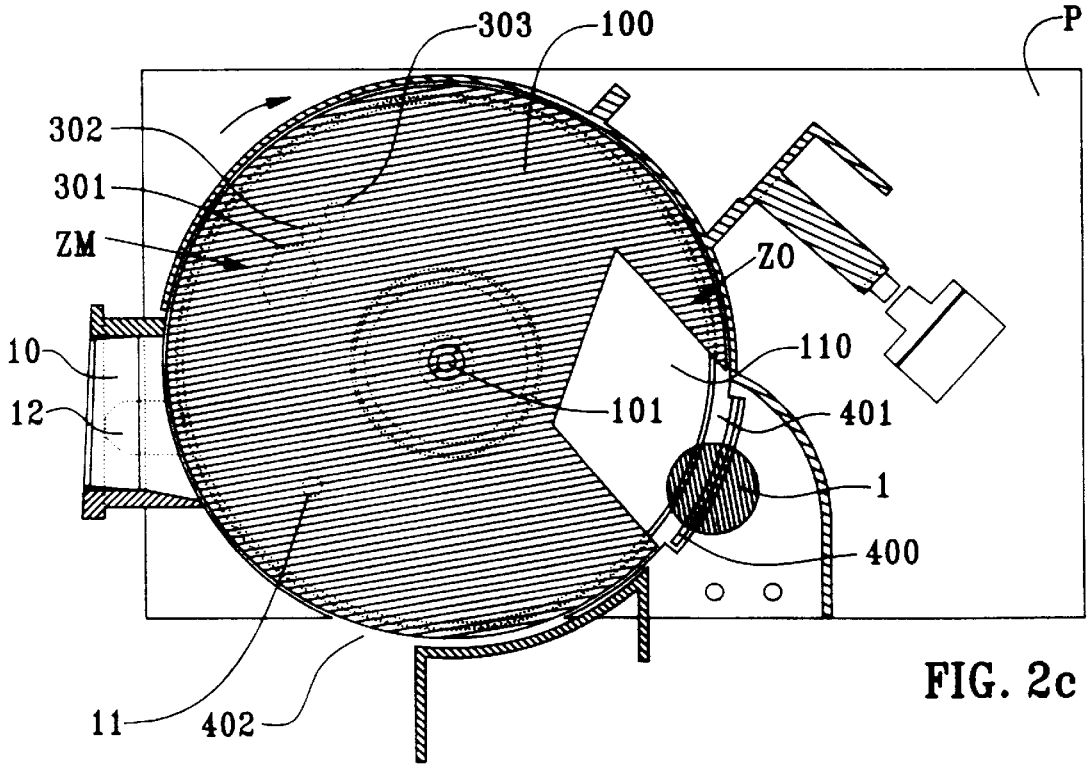

As shown more particularly in FIG. 2*c*, at the outlet from the measurement zone ZM where the object 1 has been recognized as in conformity or not, the transport wheel 100 continues to rotate without interruption so that the path of the housing 110 also passes in continuous manner through a zone ZO where objects are accepted or rejected by being put through an encashment outlet 401 or a return outlet 402, the accept or reject zone ZO naturally being after the measurement zone ZM.

Figure 2D:
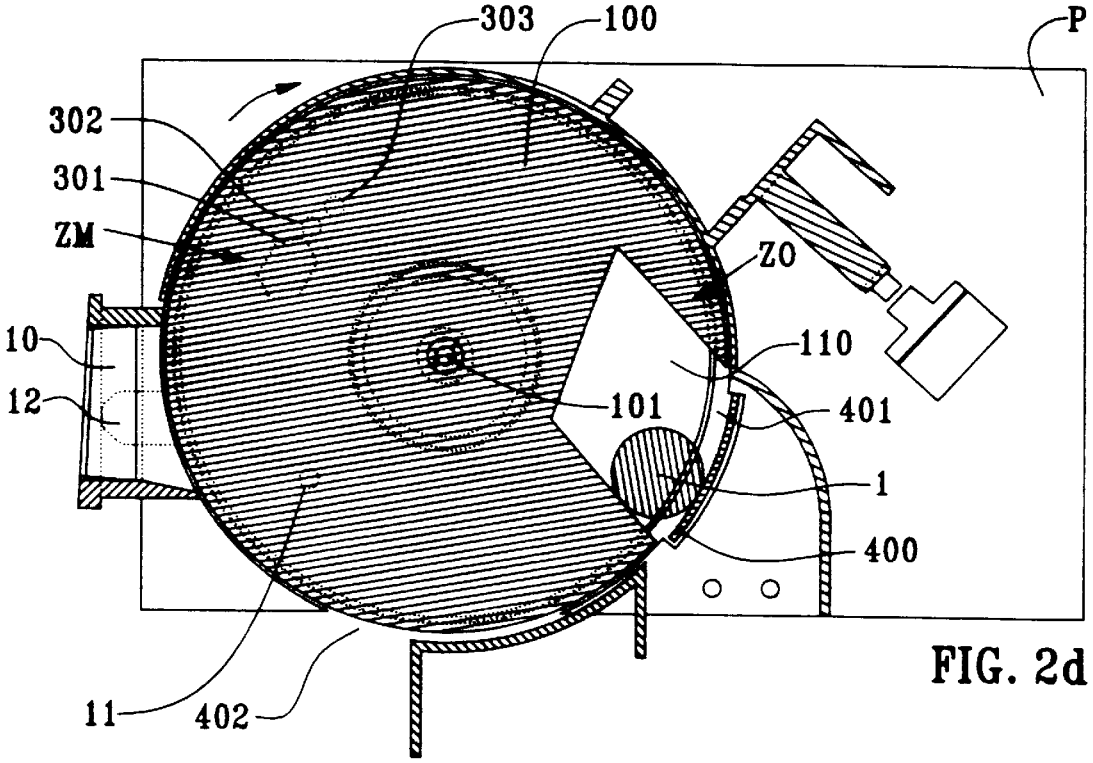
Figure 2E:
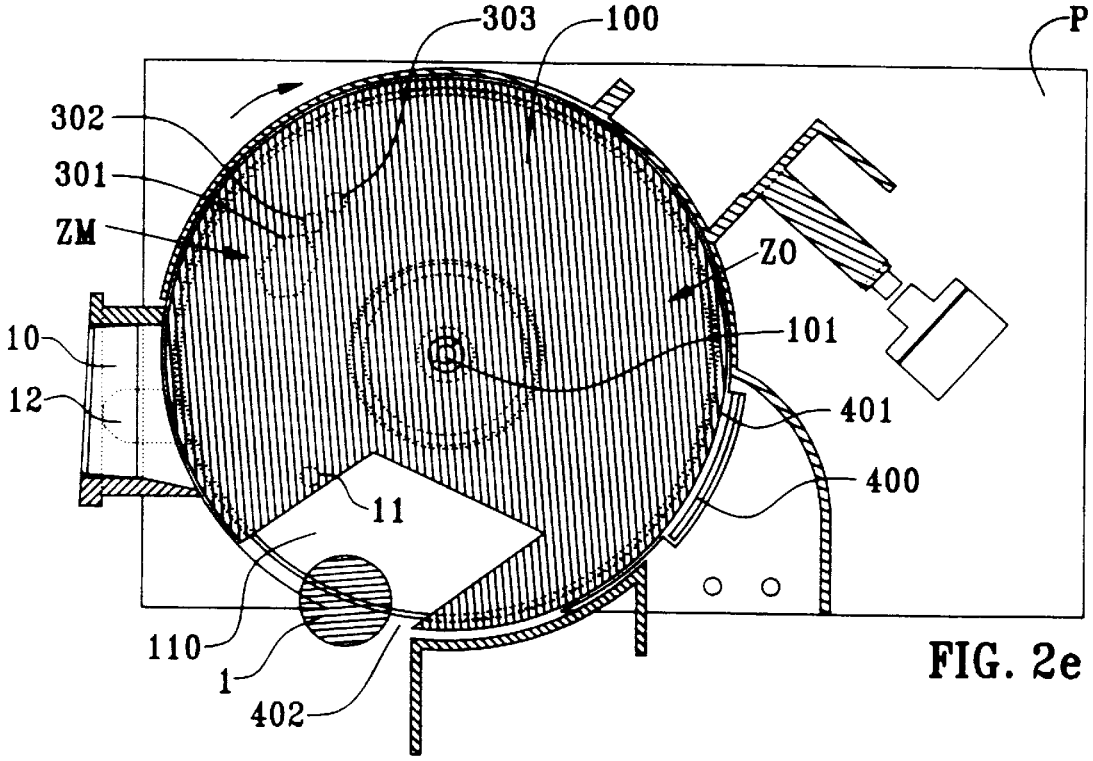

In the embodiment shown in FIGS. 2*c*, 2*d*, and 2*e*, the encashment and return outlets 401 and 402 are disposed in series relative to the continuous movement of the transport wheel 100. The encashment outlet 401 may be closed by a moving flap 400 situated at the periphery of the wheel. By way of example, said flap 400 is moved in translation parallel to the axis of rotation 101 of the wheel 100, with the stroke of the flap then being slightly greater than the thickness of the housing 110 formed in the wheel. For thicknesses that are small compared with the other dimensions, the resulting stroke is very small and therefore enables very fast translation to be performed between the open position and the closed position.

The flap 400 under the control of an electromagnet (not shown) is normally in its open position and it is moved into the closed position only if the object 1 is recognized as not being in conformity on leaving the measurement zone ZM.

Thus, in the accept or reject zone ZO, the object 1 is liable, under the effect of gravity, to pass through the encashment outlet 401 assuming the object has been recognized as being in conformity.

In contrast, if it has not been recognized as being in conformity, the object 1 cannot pass through the encashment outlet 401 because the moving flap 400 will previously have been put into the closed position. As the movement of the transport wheel 100 continues, the object 1 is then taken to the return outlet 402 which remains permanently open. The position of the housing 101 shown in FIG. 2*e* and corresponding to said housing being put into communication with the return outlet 402 constitutes the final or waiting position P2. It is in this position P2 that the continuous movement of the transport wheel 100 is interrupted, waiting for a new object to be inserted into the selector device.

This waiting position P2 serves as a reference for the movement of the transport wheel 100. For this purpose, a slot (not shown) is formed in the rim of the wheel, and when it comes into coincidence with an optical fork (not shown), it provides a reference signal. This signal in association with the sampling signals makes it possible at all times to know the exact position of the wheel 100.

When a metal object is engaged in the insertion orifice 10, a magnetic presence sensor controls the motor 200 to bring the housing 110 from the waiting position P2 to the initial position P1 where it is in communication with the insertion orifice 10 so as to restart the cycle described above.

In FIG. 2*e*, it will be observed that to provide protection against acts of vandalism, when the housing 110 is in the waiting position P2, the transport wheel 100 completely closes the insertion orifice 10, since the width of the orifice is smaller than that of the wheel rim.

Finally, as shown in FIG. 2*b*, and to avoid external disturbances, the measurement zone ZM is disposed on the path of the housing 110 so that the means 301, 302, 303 for identifying conformity can be put into operation with a passing object 1 only after the housing 110 has ceased to be in communication with the insertion orifice 10. This serves in particular to avoid interfering light having any influence on the optical measurements.

Figure 7:
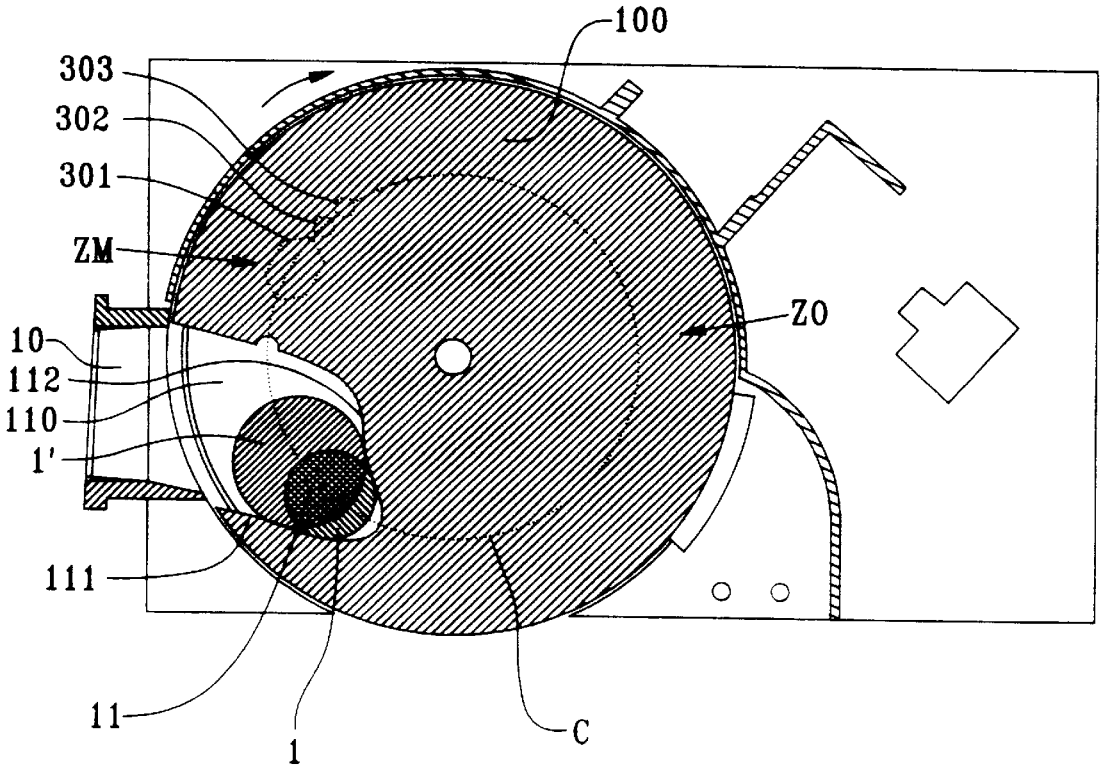
FIG. 7 shows a variant embodiment of the transport member shown in FIGS. 1 to 2*e*.

The housing 110 shown in FIGS. 1 to 2*e* includes two rectilinear contact edges 111 and 112. Nevertheless, as shown in FIG. 7, it can be advantageous, given that the objects 1 and 1' such as coins, have respective centers, for the edges 111 and 112 to be shaped in such a manner that the centers of said objects lie on a common circle C that is concentric with the transport wheel 100, and regardless of the diameter and the thickness of any particular object 1, 1'. The circle C preferably passes at least through the means 301 and 302 for taking geometrical measurements of the objects, concerning diameter and thickness, thus making it possible to obtain measurements that are absolute and independent of the size of a particular object. The optical radius of the emitter/receiver couples 302, 303 always follows the same circular arc on an object, which arc is directly represented by the diameter and thickness measurements. The rounded shape of the housing 110 eliminates any interdependence between the diameter measurement and the thickness measurement.

I claim:

1. A selector for selecting objects (1) inserted by way of payment into a dispenser of goods or services via an insertion orifice (10), said device comprising a transport member (100) provided with a housing (110) designed to receive said objects singly and suitable for bringing an object (1) placed in said housing (110) into a measurement zone (ZM) where means (301, 302, 303) are disposed for verifying conformity of said object (1), characterized in that:

said selector device also comprises drive means (200, 210) suitable for imparting a non-reversible continuous movement to said transport member (100) along a path during which said housing (110) passes from an initial position (P1) of communication with said insertion orifice (10) to a final or waiting position (P2), while passing through said measurement zone (ZM) in continuous manner, said means (301, 302, 303) for verifying conformity receiving sampling signals sampling the movement of the transport member (100); and said means for verifying conformity comprise means (301) for magnetically analyzing the material of said objects (1), suitable for expressing said analysis in terms of characteristic values of a curve representative of the magnetic signature of said objects, said characteristic values being sampled by means of said sampling signals.

2. A selector device according to claim 1, characterized in that said means for verifying conformity comprise means (302, 303) for geometrically measuring said objects, suitable for expressing said measurements in terms of numbers (n2, n3) of steps in the sampling signals, independently of the speed of the transport member (100).

3. A selector device according claim 1, characterized in that said means for driving the transport member (100) include a motor (200) and a transmission mechanism (210), said sampling signals being delivered by an encoder (300) constrained to rotate with the shaft (214) of said motor (200).

4. A selector device according to claim 3, characterized in that said coder is a code wheel (300) mounted on the shaft (214) of the drive motor (200).

5. A selector device according to claim 1, characterized in that said means for driving the transport member (100) include a transmission mechanism (210), said sampling signals being delivered by an encoder constrained to move with said transport member (100).

6. A selector device according to claim 3, characterized in that with said transport member (100) being in the form of a wheel, said transmission mechanism (210) comprises a wormscrew (213) coupled to the shaft (214) of the drive motor (200) and co-operating with teeth formed at the periphery of the wheel (100).

7. A selector device according to claim 6, characterized in that the transport wheel (100) presses against a reference plane (P) that is inclined relative to the vertical (V).

8. A selector device according to claim 7, characterized in that the housing (110) includes at least one edge (111, 112) for contacting said object (1) and having a sloping profile suitable for holding the object (1) against the reference plane (P).

9. A selector device according to claim 1, characterized in that the measurement zone (ZM) is disposed on the path of the housing (110) in such a manner that said means (301, 302, 303) for verifying conformity are implemented during the continuous movement of the transport member (100) starting from the housing's initial, communication position (P1), and after said housing (110) has ceased to be in communication with the insertion orifice (10).

10. A selector device for selecting objects (1) inserted by way of payment into a dispenser of goods or services via an insertion orifice (10), said device comprising a transport member (100) provided with a housing (110) designed to receive said objects singly and suitable for bringing an object (1) placed in said housing (110) into a measurement zone (ZM) where means (301, 302, 303) are disposed for verifying conformity of said object (1), characterized in that:

said selector device also comprises drive means (200, 210) suitable for imparting a non-reversible continuous movement to said transport member (100) along a oath during which said housing (110) passes from an initial position (P1) of communication with said insertion orifice (10) to a final or waiting position (P2), while passing through said measurement zone (ZM) in continuous manner, said means (301, 302, 303) for verifying conformity receiving sampling signals sampling the movement of the transport member (100);

said means for driving the transport member (100) include a motor (200) and a transmission mechanism (210), said sampling signals being delivered by an encoder (300) constrained to rotate with a shaft (214) of said motor (200);

with said transport member (100) being in the form of a wheel, said transmission mechanism (210) comprises a wormscrew (213) coupled to the shaft (214) of the drive motor (200) and co-operating with teeth formed at the periphery of the wheel (100);

the transport wheel (100) presses against a reference plane (P) that is inclined relative to the vertical (V); and the handedness of the wormscrew (213) is such that because of friction against said teeth, the transport wheel (100) is pressed against said reference plane (P).

11. A selector device for selecting objects (1) inserted by way of payment into a dispenser of goods or services via an insertion orifice (10), said device comprising a transport member (100) provided with a housing (110) designed to receive said objects singly and suitable for bringing an object (1) placed in said housing (110) into a measurement zone (ZM) where means (301, 302, 303) are disposed for verifying conformity of said object (1), characterized in that:

said selector device also comprises drive means (200, 210) suitable for imparting a non-reversible continuous movement to said transport member (100) along a path during which said housing (110) passes from an initial position (P1) of communication with said insertion orifice (10) to a final or waiting position (P2), while passing through said measurement zone (ZM) in continuous manner, said means (301, 302, 303) for verifying conformity receiving sampling signals sampling the movement of the transport member (100); and the path of the housing (110) between said initial and final positions (P1, P2) also passes continuously through a zone (ZO) for accepting or rejecting objects (1) directing them either to an encashment outlet (401) or to a return outlet (402) following after the measurement zone (ZM).

12. A selector device according to claim 11, characterized in that said encashment and return outlets (401, 402) are disposed in series facing the continuous movement of the transport member (100), an object (1) placed in the housing (110) being suitable, under the action of gravity, for passing through the encashment outlet (401) if the object has been recognized as being in conformity on leaving the measurement zone (ZM) or for passing through the return outlet (402) if the object is recognized as not being in conformity on leaving the measurement zone (ZM), a normally-open moving flap (400) for shutting the encashment outlet (401) being brought into a closed position.

13. A selector device according to claim 11, characterized in that said means for verifying conformity comprise means (302, 303) for geometrically measuring said objects, suitable for expressing said measurements in terms of numbers (n2, n3) of steps of the sampling signals, independently of the speed of the transport member (100).

14. A selector device according to claim 11, characterized in that said means for verifying conformity comprise means (301) for magnetically analyzing the material of said objects (1), suitable for expressing said analysis in terms of characteristic values of a curve representative of the magnetic signature of said objects, said characteristic values being sampled by means of said sampling signals.

15. A selector device according to claim 11, characterized in that said means for driving the transport member (100) include a motor (200) and a transmission mechanism (210), said sampling signals being delivered by an encoder (300) constrained to rotate with the shaft (214) of the drive motor (200).

16. A selector device according to claim 11, characterized in that said means for driving the transport member (100) include a transmission mechanism (210), said sampling signals being delivered by an encoder constrained to move with said transport member (100).

17. A selector device according to claim 15, characterized in that said transport member (100) being in the form of a wheel, said transmission mechanism (210) comprises a wormscrew (213) coupled to the shaft (214) of the drive motor (200) and co-operating with teeth formed at the periphery of the wheel (100).

18. A selector device according to claim 17, characterized in that said transport wheel (100) presses against a reference plane (P) that is inclined relative to the vertical (V).

19. A selector device according to claim 18, characterized in that the handedness of the wormscrew (213) is such that because of friction against said teeth, the transport wheel (100) is pressed against said reference plane (P).

20. A selector device according to claim 18, characterized in that the housing (110) includes at least one edge (111, 112) for contacting said object (1) and having a sloping profile suitable for holding the object (1) against the reference plane (P).

21. A selector device according to claim 11, characterized in that when the housing (110) is in the final, waiting position (P2), the transport member (100) completely closes the insertion orifice (10).

22. A selector device according to claim 11, characterized in that the measurement zone (ZM) is disposed on the path of the housing (110) in such a manner that said means (301, 302, 303) for verifying conformity are implemented during the continuous movement of the transport member (100) starting from the housing's initial, communication position (P1), and after said housing (110) has ceased to be in communication with the insertion orifice (10).

23. A selector device according to claim 11, characterized in that each of the objects (1, 1') has a center, said contact edges (111, 112) of the housing (100) being of a shape such that the centers of said objects lie on a common circle (C) concentric with the transport wheel (100).

24. A selector device according to claim 23, characterized in that said circle (C) passes at least through the means (301, 302) for geometrically measuring the objects (1, 1').

25. A selector device for selecting objects (1) inserted by way of payment into a dispenser of goods or services via an insertion orifice (10), said device comprising a transport member (100) provided with a housing (110) designed to receive said objects singly and suitable for bringing an object (1) placed in said housing (110) into a measurement zone (ZM) where means (301, 302, 303) are disposed for verifying conformity of said object (1), characterized in that:

said selector device also comprises drive means (200, 210) suitable for imparting a non-reversible continuous movement to said transport member (100) along a path during which said housing (110) passes from an initial position (P1) of communication with said insertion orifice (10) to a final or waiting position (P2), while passing through said measurement zone (ZM) in continuous manner, said means (301, 302, 303) for verifying conformity receiving sampling signals sampling the movement of the transport member (100); and when the housing (110) is in the final, waiting position (P2), the transport member (100) completely closes the insertion orifice (10).

26. A selector device for selecting objects (1) inserted by way of payment into a dispenser of goods or services via an insertion orifice (10), said device comprising a transport member (100) provided with a housing (110) designed to receive said objects singly and suitable for bringing an object (1) placed in said housing (110) into a measurement zone (ZM) where means (301, 302, 303) are disposed for verifying conformity of said object (1), characterized in that:

said selector device also comprises drive means (200, 210) suitable for imparting a non-reversible continuous movement to said transport member (100) along a path during which said housing (110) passes from an initial position (P1) of communication with said insertion orifice (10) to a final or waiting position (P2), while passing through said measurement zone (ZM) in continuous manner, said means (301, 302, 303) for verifying conformity receiving sampling signals sampling the movement of the transport member (100);

said means for driving the transport member (100) include a motor (200) and a transmission mechanism (210), said sampling signals being delivered by an encoder (300) constrained to rotate with a shaft (214) of said motor (200);

with said transport member (100) being in the form of a wheel, said transmission mechanism (210) comprises a wormscrew (213) coupled to the shaft (214) of the drive motor (200) and co-operating with teeth formed at the periphery of the wheel (100);

the transport wheel (100) presses against a reference plane (P) that is inclined relative to the vertical (V);

the housing (110) includes at least one edge (111, 112) for contacting said object (1) and having a sloping profile suitable for holding the object (1) against the reference plane (P); and each of the objects (1, 1') has a center, said contact edges (111, 112) of the housing (100) being of a shape such that the centers of said objects lie on a common circle (C) concentric with the transport wheel (100).

27. A selector device according to claim 26, characterized in that said circle (C) passes at least through the means (301, 302) for geometrically measuring the objects (1, 1').

* * * * *